United States Patent [19]

Lucius

[11] Patent Number: 4,799,908

[45] Date of Patent: Jan. 24, 1989

[54] PERSONAL FLOTATION DEVICE WITH INNER MESH LAYER

[75] Inventor: John H. Lucius, Wichita, Kans.

[73] Assignee: The Coleman Company, Inc., Wichita, Kans.

[21] Appl. No.: 19,509

[22] Filed: Feb. 26, 1987

[51] Int. Cl.[4] ..... B63C 9/10

[52] U.S. Cl. ..... 441/115; 441/111

[58] Field of Search ..... 441/106, 108, 111–115, 441/117, 88

[56] References Cited

FOREIGN PATENT DOCUMENTS 528379 11/1954 Canada ..... 441/115

136801 7/1952 Sweden ..... 441/115

*Primary Examiner*—Joseph F. Peters, Jr.

*Assistant Examiner*—Clifford T. Bartz

[57] ABSTRACT

A personal flotation device includes a back portion of buoyant material and a separate mesh layer between the back portion and the wearer of the personal flotation device for increasing the comfort of the personal flotation device. The mesh layer and the buoyant material are connected together at the top and bottom and are unconnected along at least a portion of the sides, and the length of the mesh layer is less than the length of the buoyant material so that the buoyant material buckles outwardly away from the wearer.

7 Claims, 2 Drawing Sheets

FIG. 1
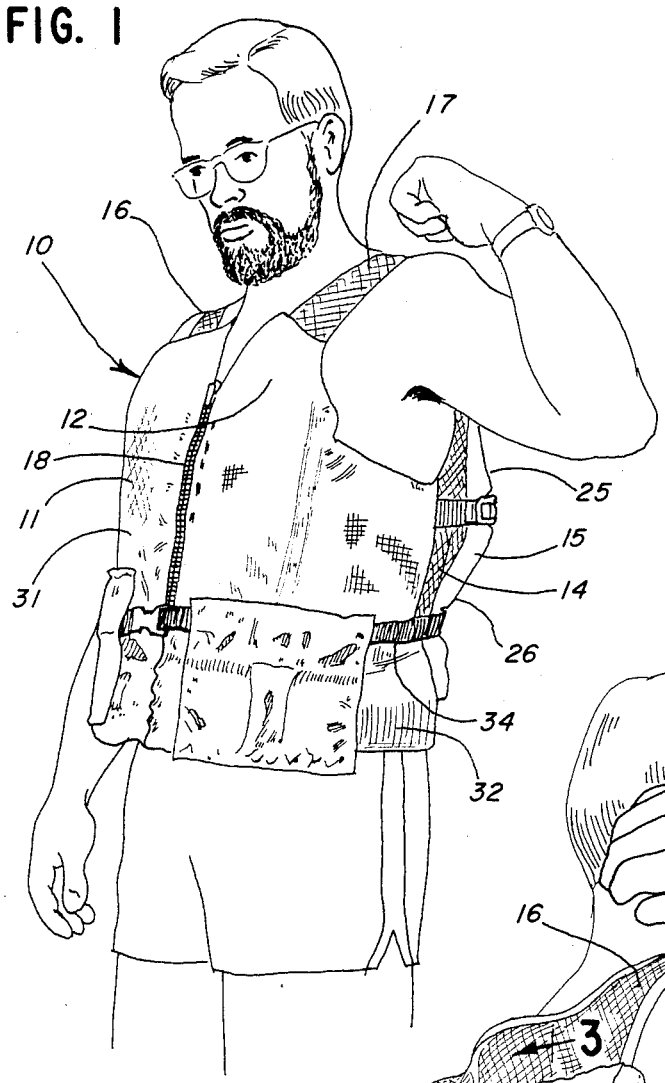
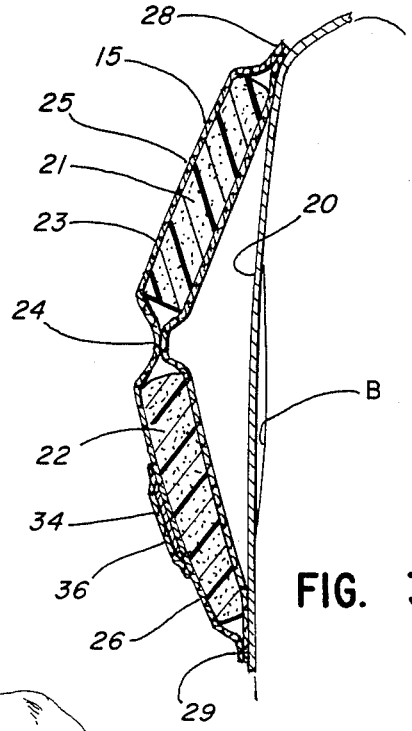
FIG. 3
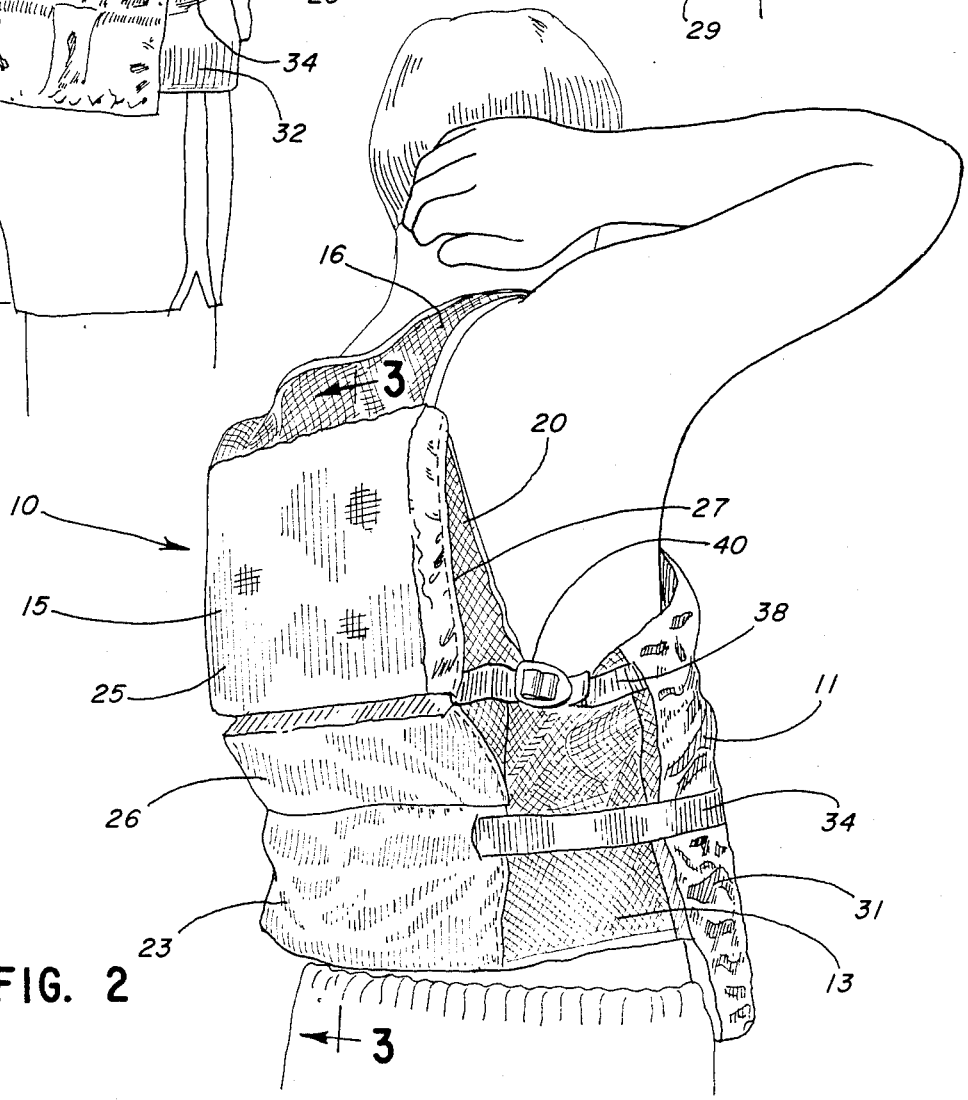
FIG. 2

FIG. 4
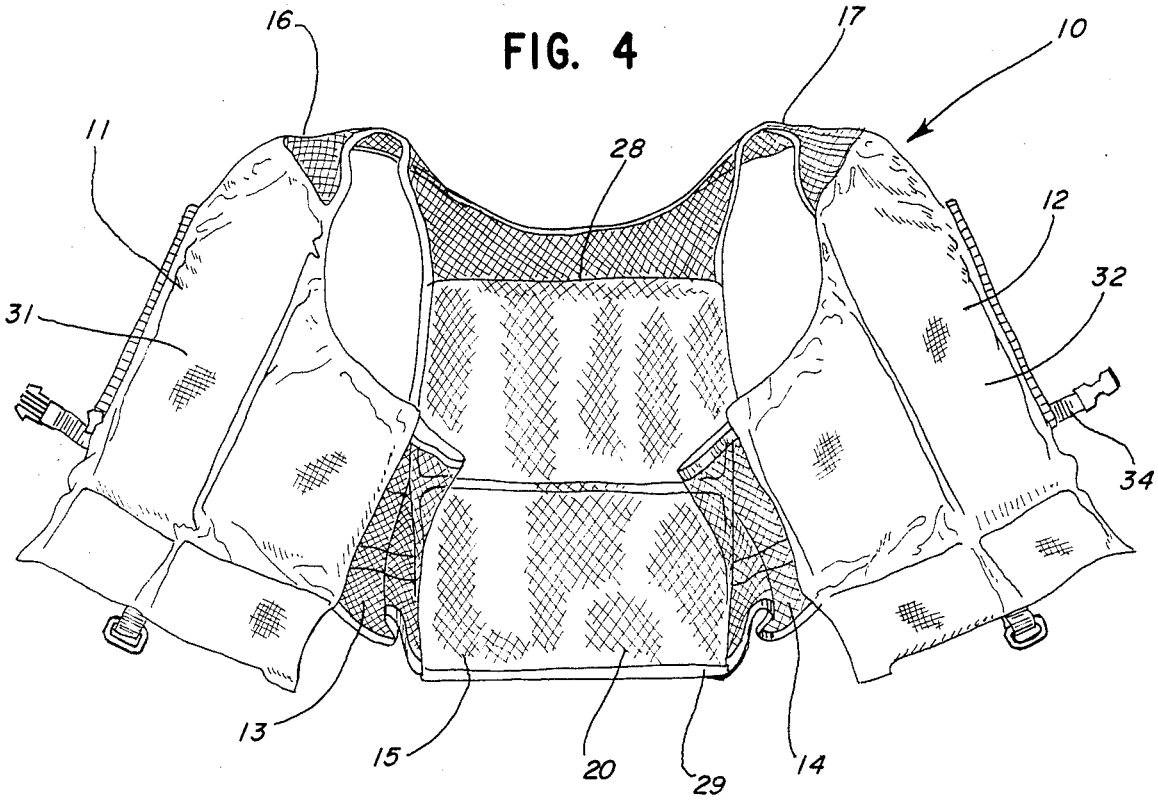
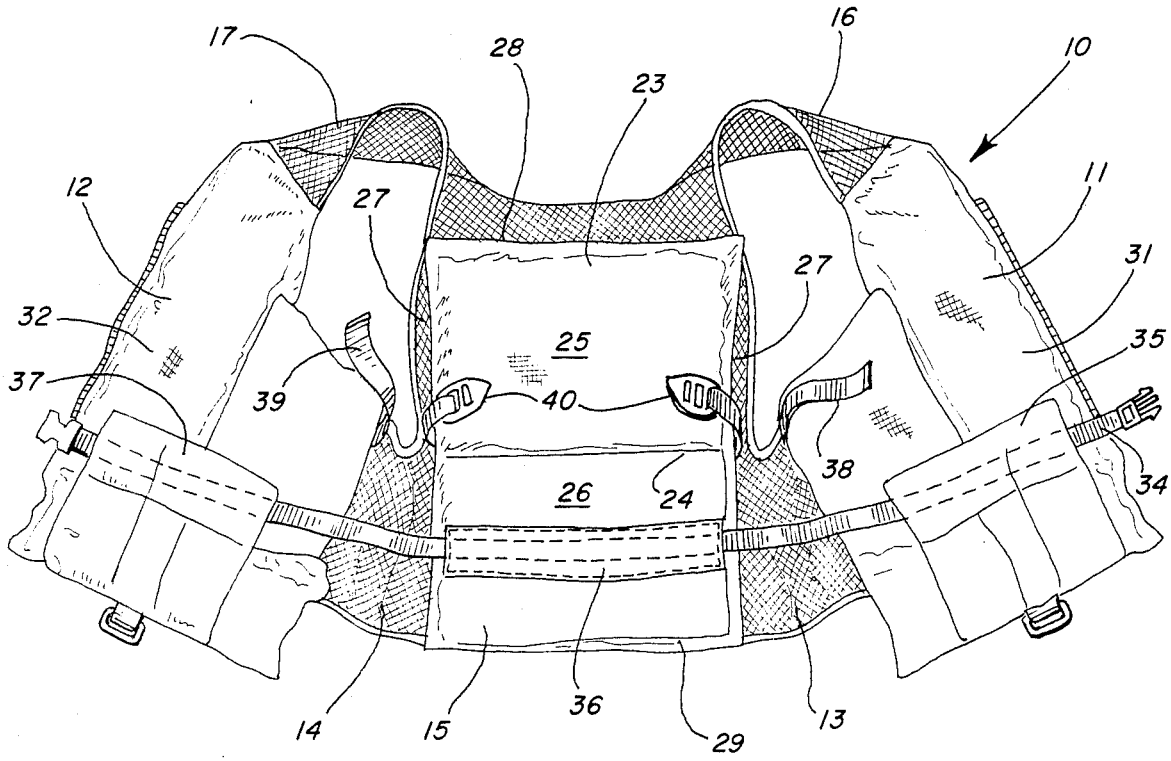
FIG. 5

PERSONAL FLOTATION DEVICE WITH INNER MESH LAYER

BACKGROUND

This invention relates to personal flotation devices, and, more particularly, to a personal flotation device which includes an inner mesh layer which spaces the back of the personal flotation device from the wearer for increasing the comfort of the device.

Personal flotation devices, sometimes called PFD's, life jackets, or life vests, are required by United States Coast Guard regulations for recreational boats. Personal flotation devices are formed from buoyant material such as closed cell plastic foam or kapok. The buoyant material may be enclosed within an outer layer or cover of woven fabric, vinyl, etc.

Obviously, a personal flotation device is effective only if it is being worn at the time of an accident. However, because personal flotation devices are hot and uncomfortable to wear, many water sports participants do not wear them.

The closed cell plastic foam which is commonly used as buoyant material is not only buoyant but is a good insulator. The insulation is desirable to provide protection against hypothermia in cold water. However, the insulating feature increases the discomfort of the device, particularly when the wearer is not in the water.

SUMMARY OF THE INVENTION

The invention provides a personal flotation device which has effective buoyancy yet which is cool and comfortable to wear. The personal flotation device includes an independent mesh liner which separates the buoyant material at the back of the personal flotation device from the back of the wearer and allows free circulation of air. The mesh liner and the back buoyant material are connected together at the top and bottom but are unconnected along the sides. The length of the mesh is shorter than the length of the buoyant material, and the buoyant material therefore buckles outwardly away from the wearer. The shoulder portions and the side portions of the personal flotation device may be formed from mesh material to provide additional comfort.

DESCRIPTION OF THE DRAWING

The invention will be explained in conjunction with an illustrative embodiment shown in the accompanying drawing, in which FIG. 1 is a front perspective view of a personal flotation device formed in accordance with the invention;

FIG. 2 is a rear perspective view of the personal flotation device;

FIG. 3 is a fragmentary sectional view taken along the line 3—3 of FIG. 2;

FIG. 4 is an elevational view of the inside of the personal flotation device; and FIG. 5 is an elevational view of the outside of the personal flotation device.

DESCRIPTION OF SPECIFIC EMBODIMENT

A personal flotation device 10 includes right and left front portions 11 and 12, right and left side portions 13 and 14, a back portion 15, and right and left shoulder portions 16 and 17 which connect the back portion and the front portions. The front portions can be releasably secured together by a zipper 18 or other suitable fastening means.

Referring to FIG. 3, the back portion 15 includes a mesh fabric inner lining 20 which lies against the back B of the wearer and a pair of rectangular buoyant pads 21 and 22. The pads are enclosed by a cover 23, and the front and back layers of the cover are stitched together along stitch line 24 between the pads to form separate pockets 25 and 26 for the pads which are hinged at the stitch line. The sides of the cover are stitched together along stitch lines 27.

The buoyant pads 21 and 22 can be formed from any conventional material, preferably closed cell polyvinyl chloride foam. The cover 23 is preferably woven nylon fabric. The mesh 20 can also be formed from nylon.

The cover 23 is stitched to the mesh 20 along top and bottom stitch lines 28 and 29. The vertical length of the mesh between the stitch lines 28 and 29 is less than the total vertical length of the buoyant pads 21 and 22, and the pads therefore buckle outwardly along the stitch line 24 so that the pads are spaced from the back of the wearer. The cover 23 is not connected to the mesh 20 along at least a portion of the sides thereof and is preferably not connected to the mesh 20 except at the stitch lines 28 and 29 to facilitate buckling of the buoyant pads away from the mesh.

In the embodiment illustrated the side portions 13 and 14 are formed from mesh fabric which are continuations of the mesh back lining 20. Similarly, the shoulder portions 16 and 17 are formed from mesh fabric which are continuations of the mesh back lining.

Each of the front portions 11 and 12 are formed from one or more pads of buoyant material such as polyvinyl chloride foam which are enclosed by woven fabric covers 31 and 32, respectively. The right cover 31 is stitched to the right side portion 13 and the right shoulder portion 16. The left cover 32 is stitched to the left side portion 14 and the left shoulder portion 17.

Referring to FIG. 5, a belt 32 extends through belt loops 35, 36, and 37 which are attached, respectively, to right front fabric cover 31, back fabric cover 25, and left front fabric cover 32. Right and left adjustable straps 38 and 39 are attached to the front and back fabric covers below the arm pits. The length of each strap can be adjusted by a buckle 40.

When the personal flotation device is being worn out of the water, the belt 34 can be unbuckled and the straps 38 and 39 can be adjusted to provide a loose fit. The back buoyant pads 21 and 22 will buckle outwardly away from the wearer as illustrated in FIG. 3 and air can circulate freely between the pads and the wearer to provide a cool, comfortable feel. The mesh side portions and shoulder portions increase the comfort of the personal flotation device. The absence of buoyant material at the shoulders and the upper portions of the front and back areas permit more buoyant material to be positioned in areas which will be under water, thereby increasing the effective flotation of the device without increasing the total amount of buoyant material.

When the wearer is in the water, the personal flotation device can be tightened about the torso by buckling the belt 34 and tightening the straps 38 and 39. The back pads are thereby pulled against the back of the wearer to provide better insulation.

The preferred embodiment of the invention includes a back pad which has separate buoyancy pads which are hinged together. However, other means for spacing the buoyant material from the mesh lining can be used. For example, the buoyant material could be molded in a curved shape.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A personal flotation device comprising a back portion, right and left front portions, right and left shoulder portions connecting the back portion and the right and left front portions, and right and left side portions connecting the back portion and the right and left front portions, the back portion having an inner mesh layer adapted to lie against the back of the wearer of the personal flotation device and an outer layer of buoyant material, the inner mesh layer and the outer buoyant layer being connected together at the top and bottom thereof and being unconnected along at least a portion of the sides thereof, the length of the inner mesh layer between the top and bottom connections between the inner mesh layer and the outer buoyant layer being less than the length of the outer buoyant layer for spacing the outer buoyant layer away from the inner mesh layer when the personal flotation device is worn whereby air can pass between the outer and inner layers.

2. A personal flotation device comprising a back portion, right and left front portions, right and left shoulder portions connecting the back portion and the right and left front portions, the right and left side portions connecting the back portion and the right and left front portions, the back portion having an inner mesh layer adapted to lie against the back of the wearer if the personal flotation device and an outer layer of buoyant material, the inner mesh layer and the outer buoyant layer being connected together at the top and bottom thereof and being unconnected along at least a portion of the sides thereof, said outer layer of buoyant material comprising upper and lower pads of plastic foam and a fabric cover enclosing said pads, the fabric covering being stitched together between said pads to form a hinge whereby the pads can buckle outwardly away from the wearer along said hinge for spacing the outer buoyant layer away from the inner mesh layer when the personal device is worn whereby air can pass between the outer and inner layers.

3. The personal flotation device of claim 2 in which the length of the inner mesh layer between the top and bottom connections between the inner mesh layer and the outer buoyant layer is less than the length of the outer buoyant layer to provide said spacing means.

4. The personal flotation device of claim 3 in which each of said right and left front portions comprises a pad of plastic foam and a fabric cover enclosing the pad.

5. The personal flotation device of claim 4 in which said right and left shoulder portions are formed from mesh material.

6. The personal flotation device of claim 4 in which said right and left side portions are formed from mesh material.

7. The personal flotation device of claim 4 including a belt extending around the personal flotation device for pulling the outer buoyant layer toward the inner mesh layer.

* * * * *

UNITED STATES PATENT AND TRADEMARK OFFICE

CERTIFICATE OF CORRECTION

PATENT NO. : 4,799,908

DATED : January 24, 1989

INVENTOR(S) : John H. Lucius

It is certified that error appears in the above-identified patent and that said Letters Patent is hereby corrected as shown below:

Col. 4, line 1 change "if" to --of--.

Col. 4, line 8 change "covering" to --cover--.

Signed and Sealed this

Thirteenth Day of June, 1989

*Attest:*

DONALD J. QUIGG

*Attesting Officer*

*Commissioner of Patents and Trademarks*